US008322435B2

(12) United States Patent
Judge et al.

(10) Patent No.: US 8,322,435 B2
(45) Date of Patent: Dec. 4, 2012

(54) PRESSURE DRIVEN SYSTEM

(75) Inventors: Robert Arnold Judge, Houston, TX (US); Peringandoor Raman Hariharan, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 323 days.

(21) Appl. No.: 12/774,373

(22) Filed: May 5, 2010

(65) Prior Publication Data

US 2010/0212156 A1 Aug. 26, 2010

Related U.S. Application Data

(62) Division of application No. 11/077,172, filed on Mar. 10, 2005, now Pat. No. 7,735,563.

(51) Int. Cl.

| | |
|---|---|
| ***E21B 7/12*** | (2006.01) |
| ***E21B 29/12*** | (2006.01) |
| ***E21B 43/01*** | (2006.01) |
| ***F04B 17/00*** | (2006.01) |

(52) U.S. Cl. ..... 166/357; 166/344; 166/368; 166/369; 417/390; 417/395; 417/401; 417/904

(58) Field of Classification Search ..... 166/341, 166/336, 357, 358, 368, 348, 250.15, 250.17, 166/68.5, 75.12, 344, 369, 372, 105; 417/360, 417/379, 390, 384–386, 401, 904, 395
See application file for complete search history.

(56) References Cited

U.S. PATENT DOCUMENTS

| | | | | |
|---|---|---|---|---|
| 3,436,914 | A * | 4/1969 | Rosfelder | 60/398 |
| 3,654,995 | A | 4/1972 | Sizer | |
| 3,677,001 | A | 7/1972 | Childers et al. | |
| 3,816,034 | A | 6/1974 | Rosenquest, Jr. | |
| 3,987,708 | A * | 10/1976 | Uhrich | 92/134 |
| 4,003,679 | A * | 1/1977 | McManigill | 417/246 |
| 4,095,421 | A * | 6/1978 | Silcox | 60/398 |
| 4,124,488 | A | 11/1978 | Wilson | |
| 4,178,240 | A | 12/1979 | Pinkerton | |
| 4,405,291 | A | 9/1983 | Canalizo | |
| 4,459,089 | A | 7/1984 | Vincent et al. | |
| 4,488,853 | A | 12/1984 | Benson | |
| 4,502,848 | A | 3/1985 | Robertson et al. | |
| 4,523,901 | A | 6/1985 | Schippers et al. | |

(Continued)

OTHER PUBLICATIONS

Non-Final Office Action, Official Communication issued by USPTO on Sep. 5, 2008 in related U.S. Appl. No. 11/077,499, filed on Mar. 10, 2005 in the name of Robert Arnold Judge et al.

(Continued)

*Primary Examiner* — Matthew Buck
(74) *Attorney, Agent, or Firm* — Potomac Patent Group PLLC

(57) ABSTRACT

A pressure driven pumping system includes a piston disposed within a first bore of a housing to separate a process chamber from a working chamber. A rod member coupled to the separating member extends into a reduced pressure chamber. The piston has a first face exposed to the process chamber and a second face exposed to the working chamber. The second face has an effective area less than an effective area of the first face. The housing may be placed in seawater at a selected depth. The process chamber can be in fluid communication with a well to pass well fluid into the process chamber at well pressure to move the piston, to discharge seawater from the seawater chamber. The working fluid, typically seawater in a subsea application, is pumped into the working chamber to move the piston, which discharges well fluid from the process chamber.

20 Claims, 8 Drawing Sheets

U.S. PATENT DOCUMENTS

| | | | | |
|---|---|---|---|---|
| 4,580,952 | A | 4/1986 | Eberle | |
| 4,606,709 | A | 8/1986 | Chisolm | |
| 4,611,973 | A | 9/1986 | Birdwell | |
| 4,649,704 | A * | 3/1987 | Marsh | 60/415 |
| 4,705,458 | A | 11/1987 | St. Laurent et al. | |
| 4,705,462 | A | 11/1987 | Balembois | |
| 4,777,800 | A | 10/1988 | Hay, II | |
| 4,830,583 | A * | 5/1989 | Edson | 417/318 |
| 4,880,363 | A * | 11/1989 | Holland | 417/390 |
| 5,064,350 | A * | 11/1991 | Ege | 417/63 |
| 5,076,890 | A | 12/1991 | Balembois | |
| 5,220,943 | A * | 6/1993 | Zink | 137/565.17 |
| 5,564,912 | A * | 10/1996 | Peck et al. | 417/396 |
| 5,575,625 | A | 11/1996 | Castel | |
| 5,616,005 | A * | 4/1997 | Whitehead | 417/46 |
| 5,616,009 | A * | 4/1997 | Birdwell | 417/342 |
| 5,634,779 | A * | 6/1997 | Eysymontt | 417/342 |
| 6,102,673 | A | 8/2000 | Mott et al. | |
| 6,202,753 | B1 | 3/2001 | Baugh | |
| 6,203,696 | B1 | 3/2001 | Pearson | |
| 6,263,971 | B1 | 7/2001 | Giannesini | |
| 6,325,159 | B1 * | 12/2001 | Peterman et al. | 175/7 |
| 6,415,877 | B1 | 7/2002 | Fincher et al. | |
| 6,457,529 | B2 * | 10/2002 | Calder et al. | 166/368 |
| 6,470,975 | B1 | 10/2002 | Bourgoyne et al. | |
| 6,478,552 | B1 * | 11/2002 | Batten et al. | 417/393 |
| 6,505,691 | B2 | 1/2003 | Judge et al. | |
| 6,592,334 | B1 | 7/2003 | Butler | |
| 6,648,081 | B2 | 11/2003 | Fincher et al. | |
| 6,719,071 | B1 | 4/2004 | Moyes | |
| 6,904,982 | B2 | 6/2005 | Judge et al. | |
| 7,108,006 | B2 * | 9/2006 | Armstrong | 137/14 |
| 7,159,662 | B2 * | 1/2007 | Johansen et al. | 166/374 |
| 7,204,679 | B2 * | 4/2007 | Wheeler | 417/390 |
| 7,252,148 | B2 * | 8/2007 | Traylor | 166/370 |
| 7,735,563 | B2 * | 6/2010 | Judge et al. | 166/357 |
| 2004/0007392 | A1 | 1/2004 | Judge et al. | |
| 2004/0031622 | A1 * | 2/2004 | Butler et al. | 175/5 |
| 2006/0008364 | A1 | 1/2006 | Traylor | |
| 2006/0102387 | A1 | 5/2006 | Bourgoyne et al. | |
| 2006/0204375 | A1 * | 9/2006 | Judge et al. | 417/393 |

OTHER PUBLICATIONS

H. J. Grimstad, "Subsea Multiphase Boosting—Maturing Technology Applied for Santos Ltd's Mutineer and Exeter Field," Society of Petroleum Engineers International (SPE 88562), Oct. 2004, 10 pages.

* cited by examiner

PRESSURE DRIVEN SYSTEM

CROSS-REFERENCE TO RELATED APPLICATIONS

The present application is related to a co-pending U.S. patent application Ser. No. 11/077,499 filed herewith titled "Pressure Driven Pumping System"assigned to the assignee of the present application. That application is incorporated herein by reference in its entirety.

BACKGROUND OF INVENTION

1. Field of the Invention

The invention relates generally to pumps for use in the hydrocarbon recovery industry, and in particular to a pressure driven pumping system for pumping hydrocarbons from a well.

2. Background Art

Pumps are used for a variety of tasks in the oil and gas industry. In particular, pumps are often used in subsea applications, such as for operating pressure driven subsea equipment (BOPS, gate valves, and the like), for bringing drilling mud to the surface while drilling, and for bringing produced fluids from a completed well to the surface.

Examples of pumping systems are disclosed in various patents. U.S. Pat. No. 6,202,753 discloses an accumulator for use in deepwater operational and control systems. The apparatus uses a differential between a high pressure ambient pressure source such as seawater pressure and a low pressure source such as a chamber holding vacuum or atmospheric pressure to provide storage and delivery of hydraulic power for operation of equipment.

U.S. Pat. No. 6,325,159 discloses a system for drilling a subsea well from a rig through a subsea wellhead below the rig including a wellhead stack mounted on the subsea wellhead. The wellhead stack includes at least a subsea blowout preventer stack and a subsea diverter. A drill string extends from the rig through the wellhead stack into the well to conduct drilling fluid from the rig to a drill bit in the well. A riser which has one end coupled to the wellhead stack and another end coupled to the rig internally receives the drill string such that a riser annulus is defined between the drill string and the riser. A well annulus extends from the bottom of the well to the subsea diverter to conduct fluid away from the drill bit. A pump has a suction side in communication with the well annulus and a discharge side in communication with the rig and is operable to maintain a selected pressure gradient in the well annulus.

U.S. Pat. No. 6,263,971 discloses a system used for production of petroleum effluents situated at great water depths. The system includes an intermediate floating station situated below the surface at a depth selected according to the pressure of the effluent at the outlet of wellheads situated on the station, production risers communicating with the well to be worked, an anchor including production risers, a pump situated on the floating station which transfers the effluent to a processing or destination site, a transfer which transfers the effluent between the floating station, the water bottom and a final platform or a processing plant, and an energy source providing necessary energy to the various equipments installed on the floating station.

One problem with producing fluids through a subsea wellhead is that pressure in the formation generally decreases over time, affecting the demands on the pumping system used to bring fluids to the surface. In particular, it is desirable for the pumping system to be capable of pumping fluid to the surface even when well fluid pressure has decreased below ambient hydrostatic pressure.

SUMMARY OF INVENTION

According to one aspect of the invention, a pressure driven pumping system is disclosed. A separating member is disposed within a first bore of a housing to separate a process chamber from a working chamber. The separating member is movable within the housing. A rod member coupled to the separating member extends into a reduced pressure chamber. The reduced pressure chamber is sealed from the working chamber and is configured for sustaining a pressure less than a pressure in the working chamber. Other aspects of the invention include a method of manufacturing a pressure driven pumping system and a method of pumping fluid from a subsea well.

Further aspects and advantages of the invention will be apparent from the following description and the appended claims.

DETAILED DESCRIPTION

In one aspect of the invention, a pressure driven pumping system employs a positive displacement pumping element to pump well fluids from a subsea wellhead to the surface. Well fluid enters a process chamber and moves a piston during a fill stroke. Seawater is then pumped to a working chamber to move the piston the opposite direction during a pump stroke, thereby pumping the well fluid. The piston may have a stepped configuration, such that well fluid pressure on the process side acts on a greater piston area than seawater hydrostatic pressure on the working fluid side, enabling the lower pressure well fluid to drive the piston against higher pressure seawater.

Figure 1:
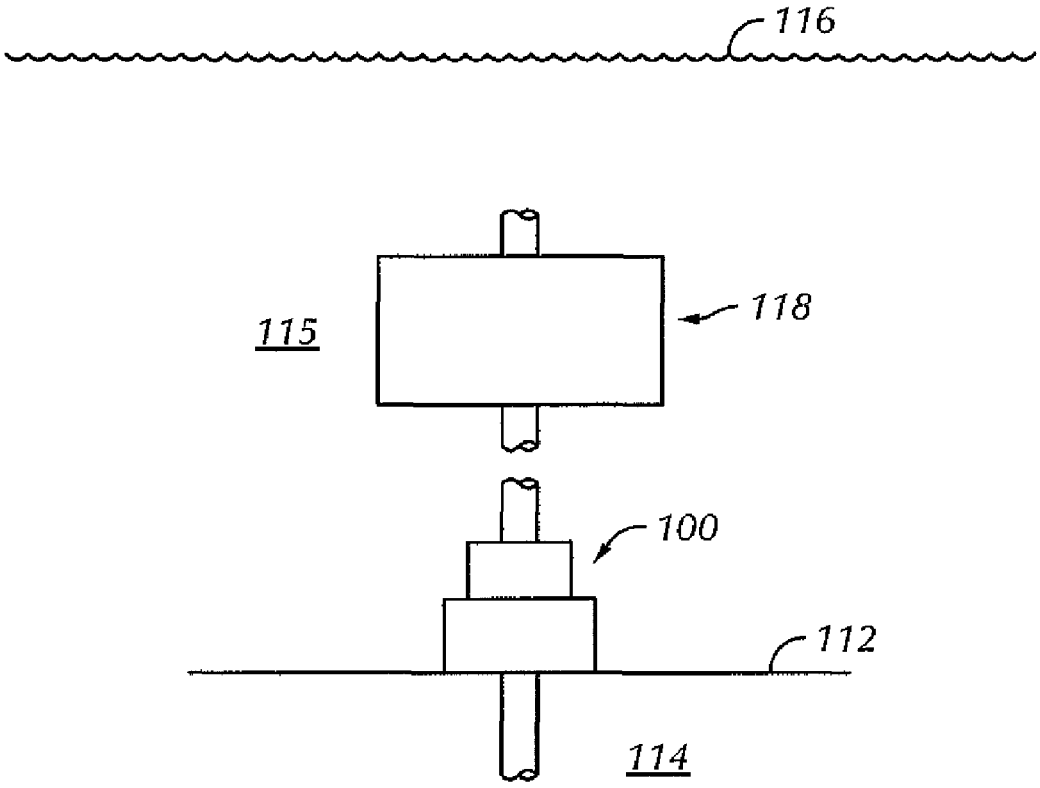
FIG. 1 conceptually depicts the environment of a subsea wellhead system for controlling fluid flow from a subsea formation.

FIG. 1 depicts a simplified version of a subsea wellhead system 100 for controlling fluid flow from a subsea formation 114 to above a waterline 116 (the "surface") where it can be transported to another location for further processing. The subsea wellhead system 100 may include sub-systems known in the art, such as production "christmas trees," for producing fluids from a hydrocarbon formation. At least a portion of a pumping system 118 is positioned in seawater 115 for pumping flow from the wellhead system 100 to the surface 116. Pressure within a well varies over the life of the well. Initially, fluids within the formation 114 may be very high, providing much of the pressure required to lift the fluids to the surface. As time passes, pressure in the formation 114 typically decreases, even though the formation 114 is still capable of producing in profitable quantity. The pumping system 118 must therefore be usable despite changes in pressure over time, to reliably pump fluid over the life of the well.

Although the invention will be discussed primarily in the context of pumping production fluids from a completed well, those skilled in the art will appreciate that the invention may also be useful in a variety of other pressure driven pumping applications, such as for pumping drilling mud through a riserless system to a floating vessel during drilling of a well, or for powering hydraulically-actuated subsea components.

It is conventional to refer to fluid being pumped as "process fluid", e.g. produced hydrocarbons or drilling mud pumped from the well to the surface. It is also conventional to refer to fluid used to drive a pumping element as "working fluid" or "power fluid." In subsea environments, seawater is often used as the working fluid, because there is a virtually infinite supply, and because seawater hydrostatic pressure can often be used to assist the driving of the pumping element. The sea also provides an essentially limitless reservoir for discharged seawater. The description that follows will therefore refer to the working fluid as being seawater, and process fluid as being well fluid such as hydrocarbons. One of ordinary skill in the art, however, will appreciate that other working fluids and process fluids may be used in some embodiments.

Figure 2:
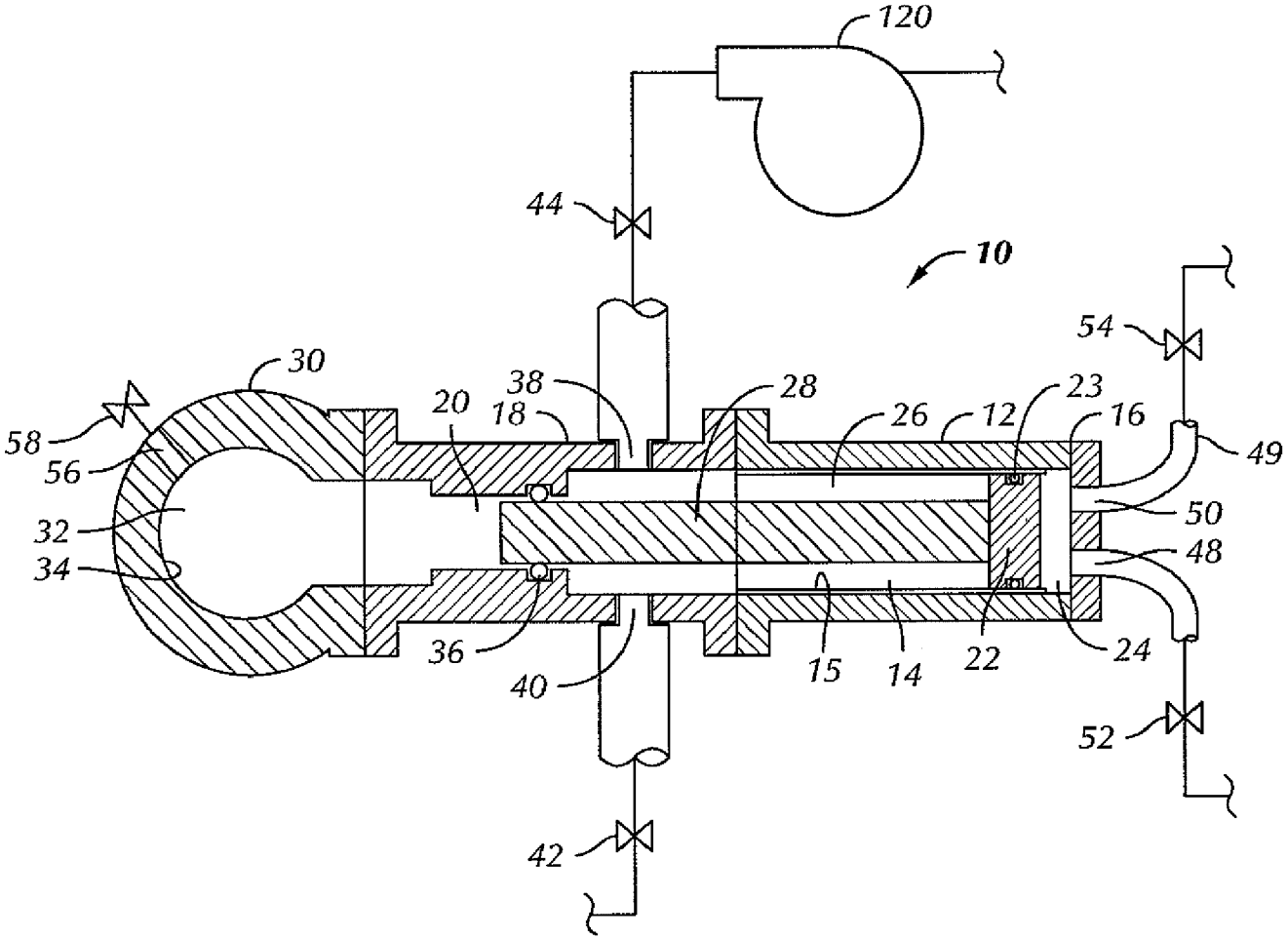
FIG. 2 illustrates one embodiment of a pressure driven pumping system in accordance with the invention.

FIG. 2 illustrates one embodiment of a positive displacement pumping element 10 according to the invention, which may be included with the pumping system 118 of FIG. 1. Multiple units of the pumping element 10 will typically be included with the pumping system 118, to increase flow capacity, provide redundancy, and so forth. A positive-displacement pump 120, depicted using a generic pump symbol, may be included with the pumping system 118. A useful characteristic of positive-displacement pumps is that, unlike centrifugal pumps, the output is substantially constant regardless of pressure on the inlet or outlet. Although a centrifugal pump may be used to pump seawater to the positive displacement pumping element 10 in an embodiment of the invention, a positive-displacement pump 120 would be expected to result in a more constant flow rate for the pumping system 118.

Various aspects and structural details of the pumping element 10 may be discussed in connection with its embodiment in FIG. 2. A housing 12 has a first bore 14 defined by interior wall 15, which may be formed in a variety of ways known in the art, such as by machining, casting, forging, or combinations thereof, and not necessarily by boring. The first bore 14 is typically circular, although other embodiments of the first bore may be differently shaped. A second bore 20 passes to the first bore 14 within the housing 12, and may be formed using similar techniques as the first bore 14.

A separating member, which in FIG. 2 is a piston 22, is disposed within the first bore 14 of the housing 12. The piston 22 is typically shaped like the first bore 14, which in this embodiment means the piston 22 is circular. The piston 22 is slidably sealed with the interior wall 15 by a sealing member 23 to separate the first bore 14 into a process chamber 24 and a working chamber 26. As shown, process chamber 24 and working chamber share the same first bore 14. The sealing member 23 may be selected from a variety of annular seals known in the art, such as an o-ring or dovetail seal. The piston 22 is movable by sliding within the first bore 14 to vary the volume of the process chamber 24 and the volume of the working chamber 26.

Still referring to FIG. 2, a reduced pressure portion 30 is included with the housing 12. The portion of the housing 12 that includes the first bore 14 may be formed separately from or as a unitary body with the reduced pressure portion 30. An interior wall 34 of the reduced pressure portion 30 defines a reduced pressure chamber 32 that can sustain low pressures, such as from 1 atm down to a near vacuum. The second bore 20 passes to the reduced pressure chamber 32.

A rod member, which in FIG. 2 is a rod 28, is coupled to the piston 22, which resides in the first bore 14. In the embodiment shown the rod 28 and piston 22 may be formed as a unitary body, or they may be welded, brazed, or otherwise joined. Conceptually, however, in other embodiments the piston 22 and rod 28 may be coupled without actually contacting one another, such as with a thin piece of wire or other intermediate member. The rod 28 is straight and cylindrical, but in other embodiment the rod need not necessarily be straight nor cylindrical.

Still referring to the embodiment of FIG. 2, the rod 28 extends through the second bore 20 from the working chamber 26 into the reduced pressure chamber 32. The reduced pressure chamber 32 is sealed from the working chamber 26 by the sealing member 36, which in this embodiment is a component of the separating member and may include any of a variety of annular seals known in the art, such as an o-ring. Thus, the reduced pressure chamber 32 is configured for sustaining a pressure less than a pressure in the working chamber 26, the importance of which is discussed in more detail below.

Those skilled in the art will recognize that the separating member need not be a piston. For instance, in other embodiments, the separating member may comprise a flexible diaphragm sealingly secured to interior wall 15. Whereas a piston varies the volume of chambers 24, 26 by sliding along interior wall 15, the flexible membrane may be fixed to the interior wall 15, and may instead move by flexing rather than sliding, to vary the volumes in chamber 24, 26.

A number of ports and valves are configured for controlling flow to and from the pumping element 10. Referring still to FIG. 2, the housing 12 includes an inlet port 38 for pumping water into the working chamber 26, and an outlet port 40 for passing seawater out of the working chamber 26 to the sea, or to a depleted subsea formation used for storing contaminated seawater. The positive-displacement pump 120 is typically positioned subsea or on a floating vessel. Fluid flow through ports 38 and 40 may be controlled with valves, such as working fluid valves 44 and 42, respectively. Port 48 allows entrance of well fluid into process chamber 24. Port 50 allows exit of well fluid from process chamber 24, through production line 49 to a pipeline or floating vessel (not shown). Flow through ports 48 and 50 may be controlled by valves such as valves 52, 54. A control unit (not shown) may be used to control the valves, as well as the seawater pump 120.

Figure 3A:
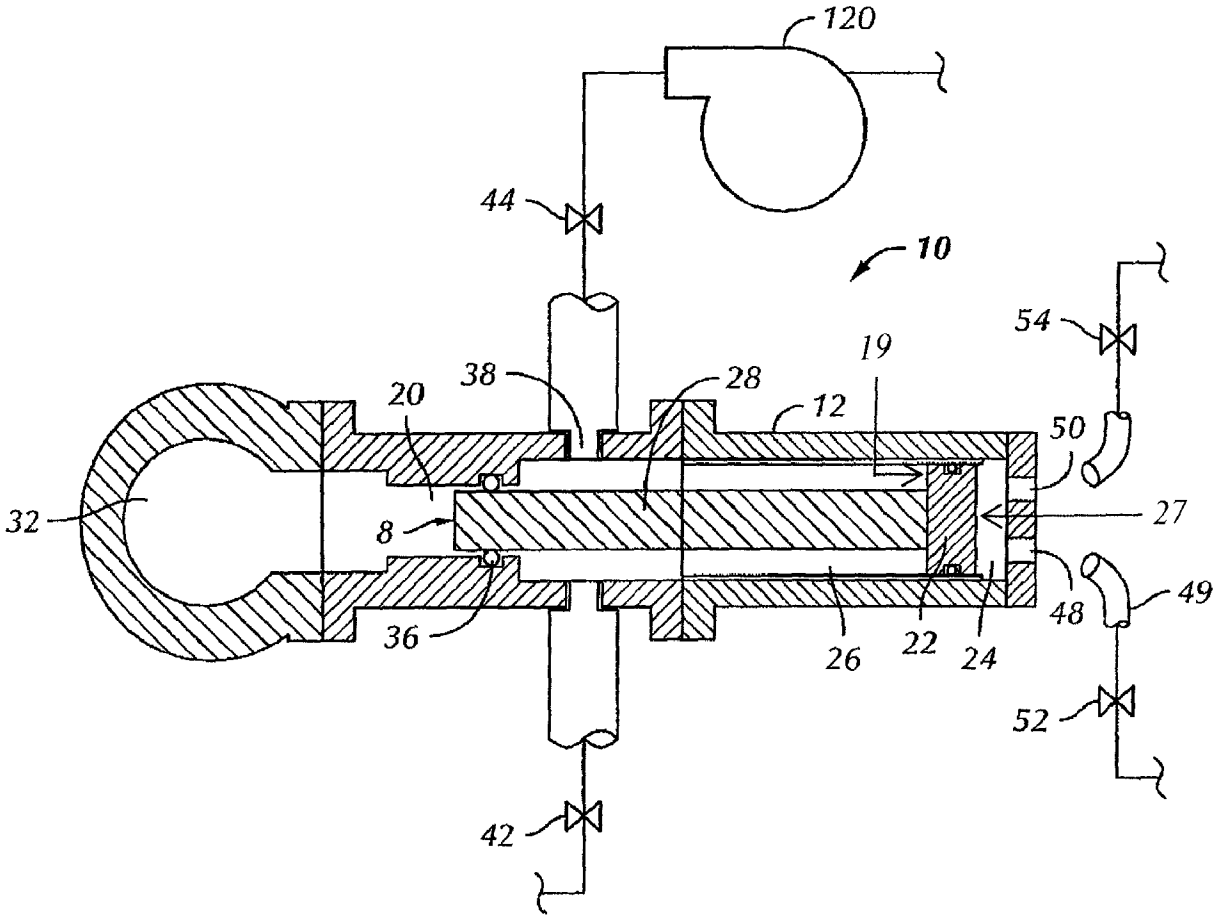
FIG. 3A illustrates the pressure driven pumping system of FIG. 2 at the beginning of a fill stroke.

Well fluid may be pumped with pump element 10 using alternating fill and pump strokes. During a fill stroke, the piston 22 is moved from its position in FIG. 3A to its position in FIG. 4 to draw in well fluid, as follows. FIG. 3A shows the pumping element 10 at the beginning of the fill stroke. Valve 54 is closed and valve 52 is opened to the process chamber 24, and valve 44 is closed and valve 42 is open to the working chamber 26. Well fluid flows from the well through line 49, past valve 52, and into the process chamber 24. Well fluid entering the process chamber 24 will typically be at about wellhead pressure, although it may deviate slightly from wellhead pressure due to line losses, elevation changes, and so forth. Well fluid pressure will move the piston 22 toward its position of FIG. 4 as well fluid enters the process chamber 24. Simultaneously, seawater in working chamber 26 will be discharged through valve 42, where it may pass to ambient seawater.

Figure 3B:
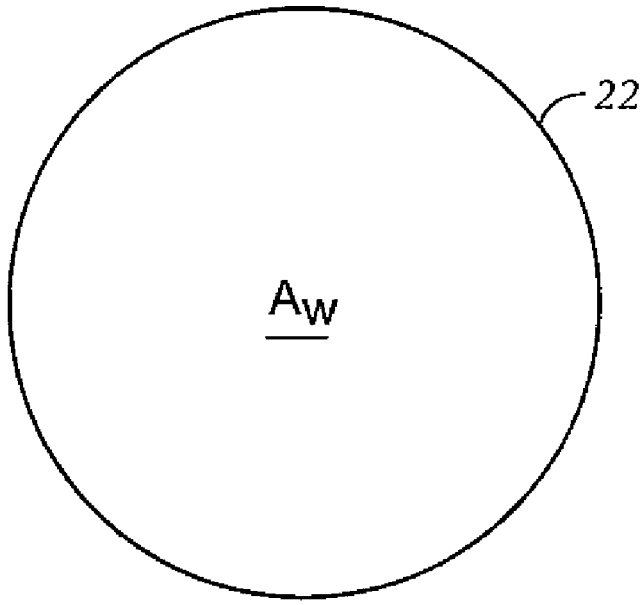
FIG. 3B illustrates the area of a piston face exposed to well fluid.
Figure 3C:
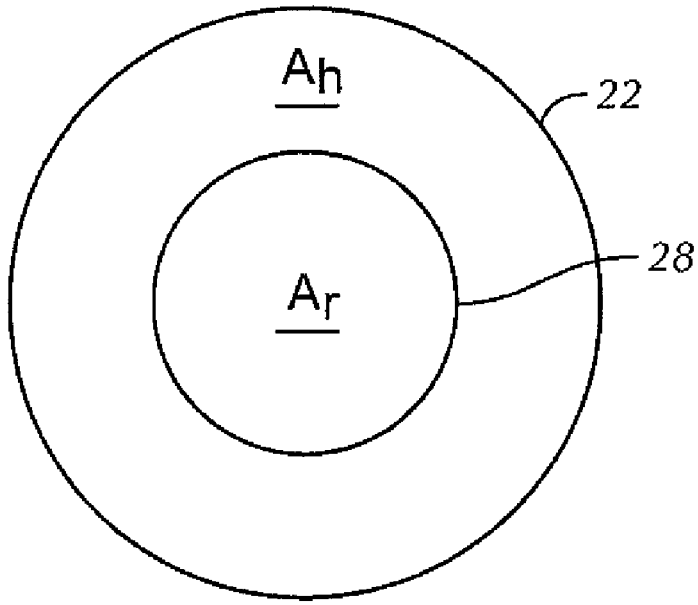
FIG. 3C illustrates the area of the piston face exposed to seawater.
Figure 4:
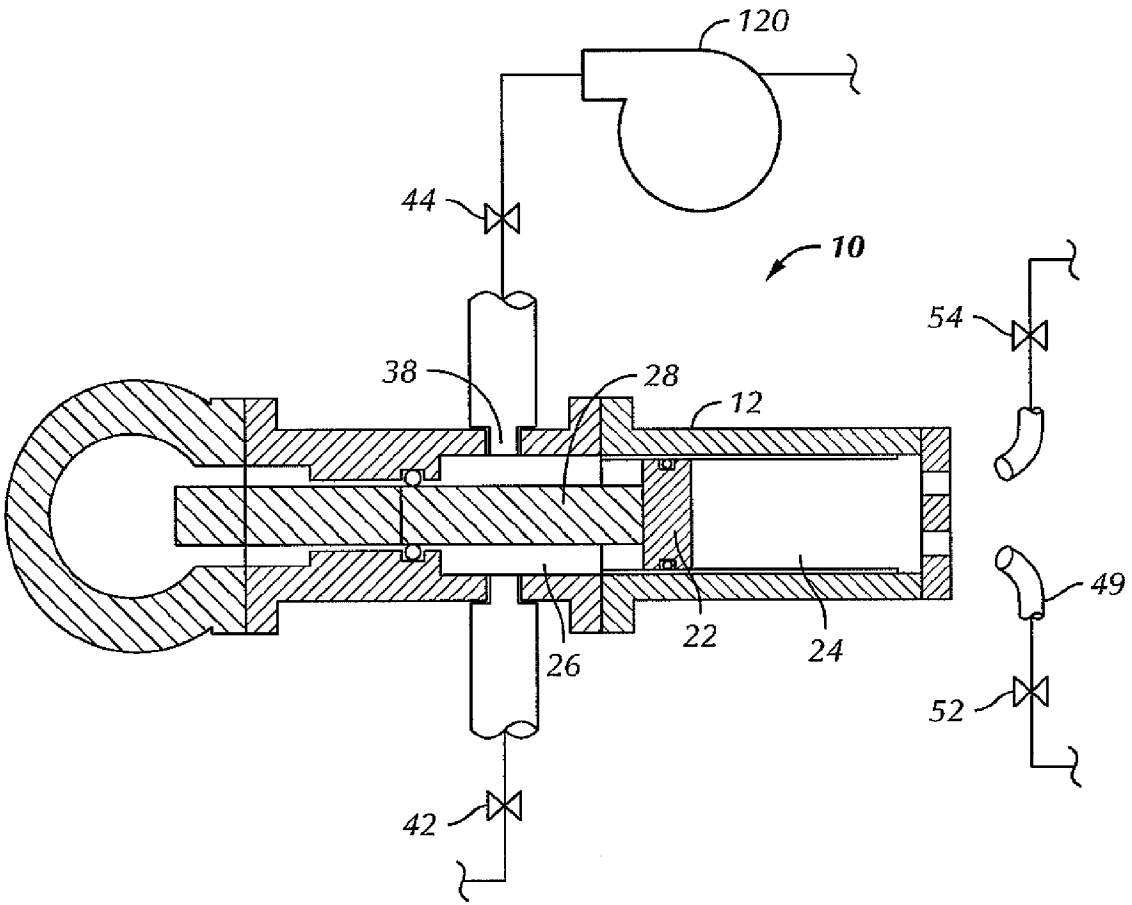
FIG. 4 illustrates the pressure driven pumping system of FIG. 2 at the beginning of a discharge stroke.

During a pump stroke, the piston 22 is moved from its position in FIG. 4 to its position in FIG. 3A. FIG. 4 shows the pumping element 10 at the beginning of the pump stroke. Valve 52 is now closed and valve 54 is now open to the process chamber 24, whereas valve 44 is open and valve 42 is closed to the working chamber 26. Seawater pump 120 pumps seawater past valve 44 into the working chamber 26, moving the piston back toward its position of FIG. 3. Simultaneously, well fluid is pumped out of process chamber 24.

The alternating fill and pump strokes described above may be used to continually pump fluid from the wellhead to the surface. Because an individual pumping element cannot simultaneously pump and fill, multiple pumping elements 10 may be configured within a flow manifold to smooth the flow of pumped well fluid. While one or more pumping elements are doing a fill stroke, one or more other pumping elements may be doing a pump stroke, so that well fluid is continuously being pumped. A number of control systems are known in the art for synchronizing multiple pumping elements to optimize flow.

The way in which well fluid pressure Pw may drive the piston 22 against seawater at higher, hydrostatic seawater pressure Ps during the fill stroke may be explained with reference to FIGS. 3A, 3B, and 3C. The piston 22 has opposing faces 27, 19. The piston face 27 exposed to well fluid has an area Aw (FIG. 3B). The well fluid thus acts on piston face 27 with a force Fw=Pw×Aw. Rod 28 has a cross sectional area Ar (FIG. 3C). The piston face 19 exposed to seawater at hydrostatic pressure has an effective area Ah=Aw−Ar. The seawater thus acts on piston face 19 with a force Fh=Ph×Ah. Because Aw is greater than Ah, the force Fw applied by well fluid may be greater than the force Fh applied by hydrostatic seawater pressure, even when the hydrostatic seawater pressure Ph is greater than well fluid pressure Fw. The pressure in reduced pressure chamber 32 is less than pressure of ambient seawater, and may maintain a reduced pressure relative to the pressure of fluid in the working chamber 26 over a full range of piston/rod travel within housing 12. This stepped configuration allows well fluid pressure to drive the fill stroke even when well pressure has dropped to below that of ambient seawater.

The effective area of the piston face exposed to well fluids is the area of the piston projected onto a plane perpendicular to the axial movement of the piston as shown in FIG. 3B. The effective area of the piston face exposed to seawater is the projected area of the piston minus the projected area of the cross sectional area where the rod 28 passes into the reduced pressure chamber 32. With reference to FIG. 3C, the effective area Ah of the piston face exposed to seawater may be computed as Ah=Aw−Ar.

Because pressure from the well may be particularly strong early in the life of the well, and significantly higher than ambient seawater pressure, the force Fw applied to piston face 27 by well fluid may initially be very high in relation to pressure imparted on piston face 19 by ambient seawater. A choke (not shown), or other flow restricting device such as valve 42, may be used to control flow out of the working chamber 26 during the fill stroke, i.e. to impart "back pressure" on the piston to minimize or prevent uncontrolled or excessively fast piston movement.

The difference between forces acting on piston face 27 and piston face 19 (Fw−Fh) depends on the relative difference in cross sectional areas Aw and Ar of the piston 22 and the rod 28, respectively. For instance, if the rod 28 were extremely thin as compared to the diameter of the piston 22, the areas Aw, Ah of piston faces 27, 19 would be nearly equal. By contrast, if the rod 28 and piston 22 had nearly the same cross sectional area, there may be too little effective area Ah on piston face 19 for working fluid to act during the pump stroke. In some embodiment, the piston and rod diameters are selected such that the second face has an effective area equal to between 25% and 75% of the effective area of the first face.

The sea is an environmentally sensitive area, and responsible well operators take necessary steps to minimize or eliminate contamination. Well fluid is a potential contaminant, so it is important to keep it from entering ambient seawater. Virtually all piston/cylinder configurations are prone to leakage during use. Thus, well fluid leaking past piston 22 from process chamber 24 to working chamber 26 may ultimately escape to the sea during fill strokes.

Figure 5:
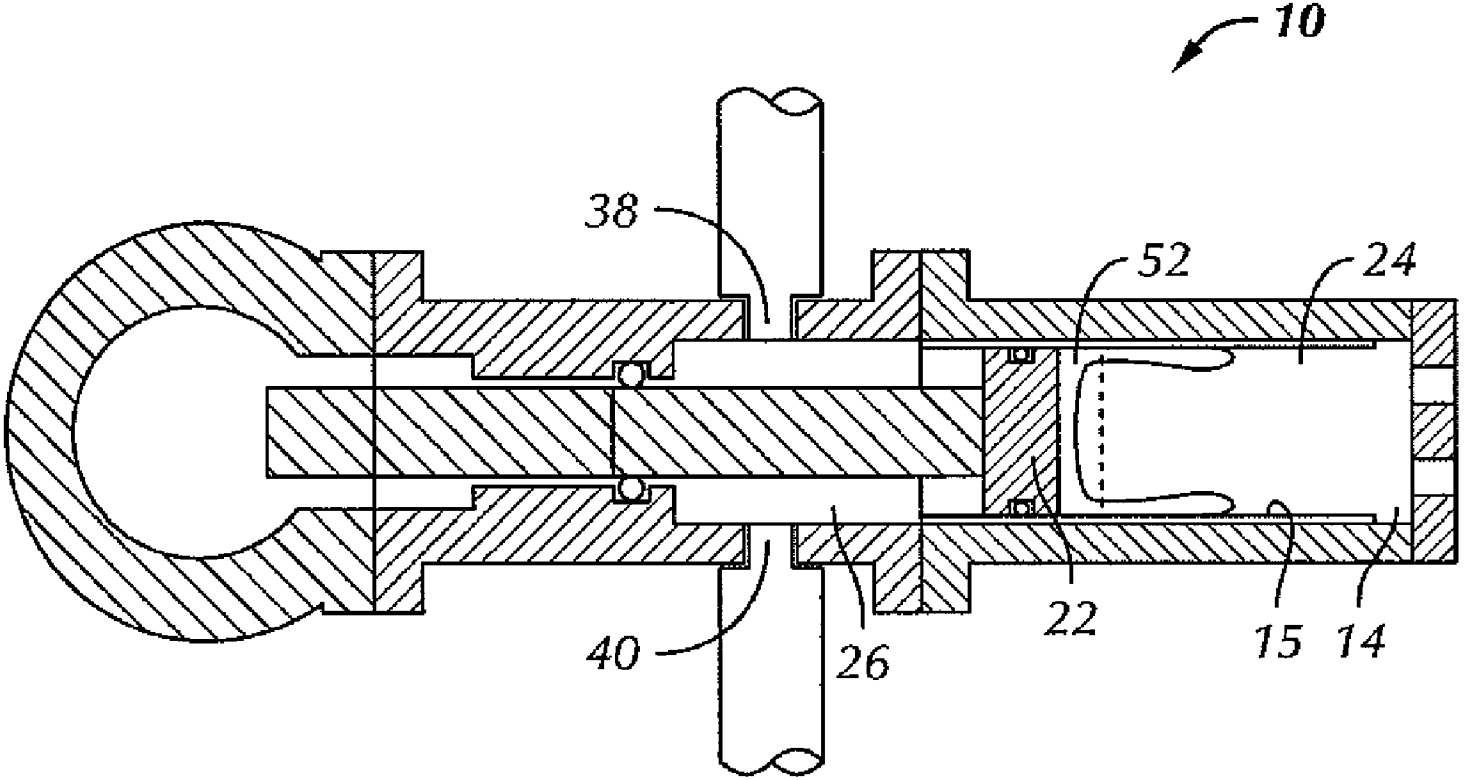
FIG. 5 illustrates an embodiment including a rolling diaphragm for preventing discharge of contaminants to ambient seawater.

FIG. 5 shows an embodiment for eliminating this type of contamination. A "rolling diaphragm" 52 is disposed within the first bore 14 and is sealed to the interior wall 15. As the piston 22 travels within the first bore 14, the rolling diaphragm 52 is flexible to accommodate movement of the piston 22 without detaching from the interior wall 15. Because diaphragm 52 is flexible, well fluids can still impart pressure to piston 22. However, well fluids in process chamber 24 cannot pass beyond the rolling diaphragm 52, and are thereby prevented from migrating past piston 22 and into working chamber 26, where they might otherwise escape to the sea. In other embodiments, the diaphragm 52 could instead be positioned within the working chamber 26 between piston 22 and outlet port 40, allowing well fluid to migrate past piston 22, but not to outlet port 40.

Another aspect of the invention is a method of using a pressure driven pumping system. The method may be discussed with reference back to the embodiment of FIG. 2. The working chamber 26 is placed in communication with ambient seawater, such as through working fluid ports 42, 44, and the process chamber 24 is placed in communication with the subsea wellhead system 100 (FIG. 1), such as through process fluid ports 48, 50.

Still referring to FIG. 2, the reduced pressure chamber 32 is set to a pressure selected as a function of hydrostatic pressure at the depth at which the pump apparatus 10 will be used. Chamber 32 may be set, for example, to about atmospheric (sea-level) pressure, so that it will be below ambient pressure at any depth of seawater. One way to set the chamber 32 to atmospheric pressure is to open it to the atmosphere at sea level via port 56, by opening valve 58 and subsequently closing valve 58, prior to submerging. Alternatively, hydrostatic pressure may be computed in advance according to the depth at which the pump apparatus 10 is to be submerged, and the pressure in chamber 32 may be set to less than hydrostatic pressure at that selected depth using a variety of pressure equipment known in the art. It may be desirable in some applications to set the pressure in chamber 32 to near vacuum. If a range of depths is anticipated, or if the depth is not precisely known in advance, the possible range of depths may be taken into account, and the pressure in chamber 32 set at less than hydrostatic pressure over that range. Likewise, if pressure was computed based on a specific selected depth, it may be advantageous to ensure the apparatus 10 is submerged to a depth of within a range of that selected depth, such as within 100 feet of that selected depth. Other vacuum or pressure systems may be used in other embodiments to remotely adjust pressure to the chamber 32 prior to or after submerging. For example, in one embodiment, an accumulator such as that disclosed in U.S. Pat. No. 6,202,753 may be used to remotely adjust pressure to the chamber 32.

With the piston 22 in the position shown in FIG. 2, the fill stroke may be initiated. To initiate the fill stroke, valve 42 is opened to vent port 40 to ambient seawater, and valve 44 is closed. Then, valve 54 is closed, and valve 52 is opened to place port 48 in communication with the wellhead system 100 (FIG. 1). Well fluid is then passed from the subsea wellhead system 100 to fill the process chamber 24 and move the piston 22 to expel seawater from the working chamber 26. As discussed above in connection with FIG. 3A, the cross sectional areas of the rod 28 and piston 22 affect the forces applied by hydrostatic seawater and well fluid driven by well pressure. A rod diameter and a piston diameter may be selected in advance according to the range of depth at which the apparatus 10 may be operated, such that a force applied by the well fluid to the piston 22 will exceed a force applied by the ambient seawater to the piston 22. Thus, the above fill stroke may be driven solely by pressure from the well, even in instances where well pressure at inlet port 48 is less than ambient hydrostatic pressure. Early in the life of the well, well fluid pressure may be high, and to control piston movement the fill stroke may comprise selectively controlling flow out of the working chamber 26 to impart back pressure on the piston 22 during the step of passing well fluid from the subsea wellhead system 100 to the process chamber 24.

Next, still referring to the structure of FIG. 2, the pump stroke may take place. Valves 42 and 52 may be closed, and valves 44 and 54 opened. Seawater may be passed into the working chamber 26 through port 38 to expel the well fluid from the process chamber 24 through port 50, which may pass to the surface. Assuming force on the piston 22 from well pressure exceeds force on the piston 22 from ambient hydrostatic pressure, seawater will need to be pumped into the working chamber 26 during discharge, rather than relying on hydrostatic pressure. Seawater pumps that can be used for this purpose are typically included on floating production vessels, and may alternatively be remotely located subsea. The pump may be placed in communication with working chamber 26 via inlet port 38.

Figure 6:
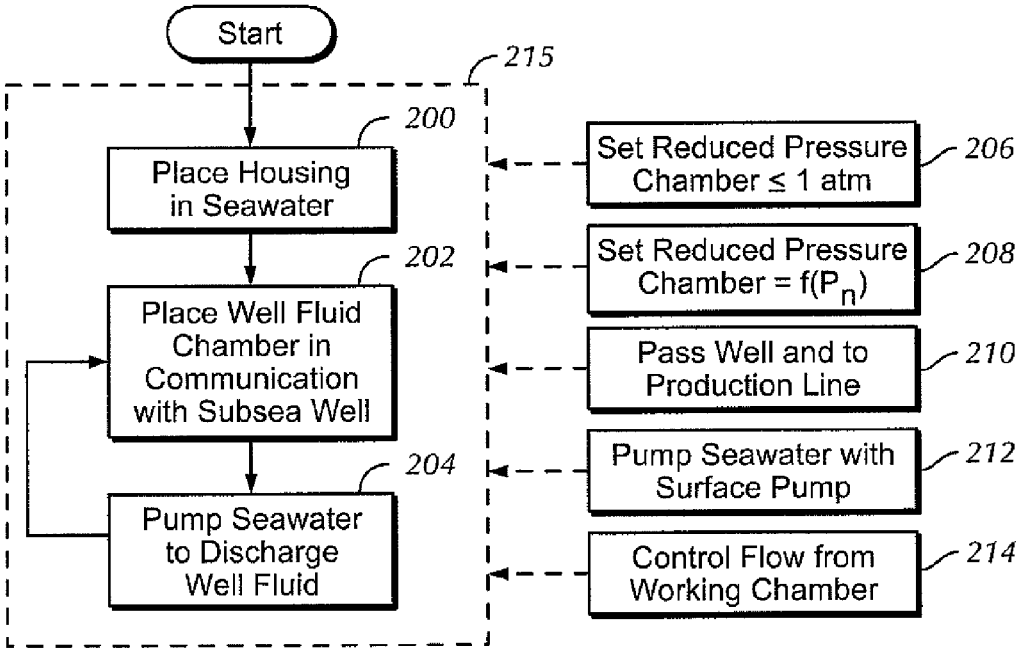
FIG. 6 illustrates a method of pumping fluid from a subsea well.

FIG. 6 illustrates a method of pumping fluid from a subsea well according to one aspect of the invention, wherein dashed lines indicate optional steps or conditions. Step 200 places a housing in seawater at a selected depth. The housing has a bore separated by a piston into a well fluid chamber and a seawater chamber. The piston has a first face exposed to the well fluid chamber and a second face exposed to the seawater chamber. The second face has an effective area less than an effective area of the first face. Main pumping loop 215 includes steps 202 and 204, as follows. Step 202 places the well fluid chamber in fluid communication with a subsea well to pass well fluid into the well fluid chamber at well pressure, thereby moving the piston to discharge seawater from the seawater chamber. The well pressure may be less than hydrostatic seawater pressure at the selected depth. The force of well pressure on the first face may be greater than the force of hydrostatic seawater pressure on the second face. Step 204 pumps seawater into the seawater chamber, thereby moving the piston to discharge well fluid from the well fluid chamber. Thus, steps 202 and 204 may be cycled repeatedly to pump well fluid from the subsea well.

Still referring to FIG. 6, in step 206 a reduced pressure chamber is set to no more than about 1 atm, and a rod extends from the piston to the reduced pressure chamber. Step 208 instead sets pressure in the reduced pressure chamber as a function of hydrostatic pressure at the selected depth. Step 210 passes the discharged well fluid to a production line extending above the housing. Step 212 pumps seawater to the seawater chamber using a pump positioned above the housing, and typically at the surface. In step 214, flow out of the working chamber may be selectively controlled while passing well fluid to the well fluid chamber.

Figure 7:
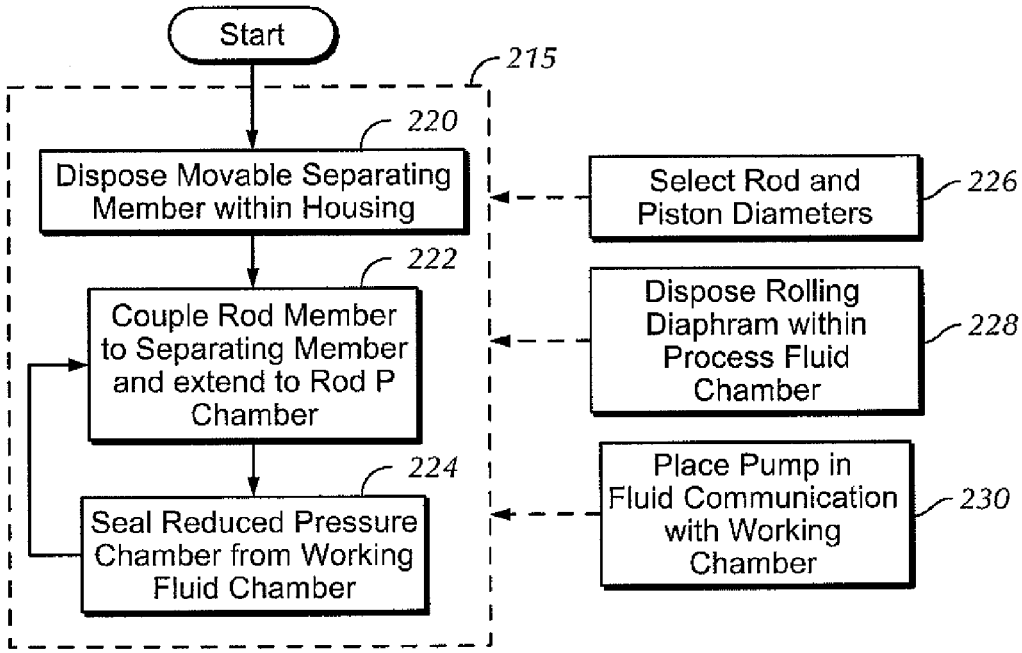
FIG. 7 illustrates a method of manufacturing a pressure driven pumping system.

FIG. 7 illustrates a method of manufacturing a pressure driven pumping system according to another aspect of the invention, wherein dashed lines indicate optional steps or conditions. The method may include as few as steps 220, 222, and 224. Step 220 disposes a separating member within a first bore of a housing to separate a process chamber from a working chamber. The separating member is movable within the housing. Step 222 couples a rod member to the separating member and extends the rod member into a reduced pressure chamber. Step 224 seals the reduced pressure chamber from the working chamber for sustaining a pressure less than a pressure in the working chamber.

Still referring to FIG. 7, a rod diameter and a piston diameter may be selected in step 226 such that a force applied by working fluid to the piston member will exceed a force applied by seawater to the piston member according to a selected range of well fluid pressure and a selected range of seawater depth. In step 228, a rolling diaphragm may be disposes within the process chamber for preventing migration of fluid from the process chamber to the working chamber. In step 230, a pump may be placed in fluid communication with the working chamber for pumping working fluid to the working chamber.

Figure 8:
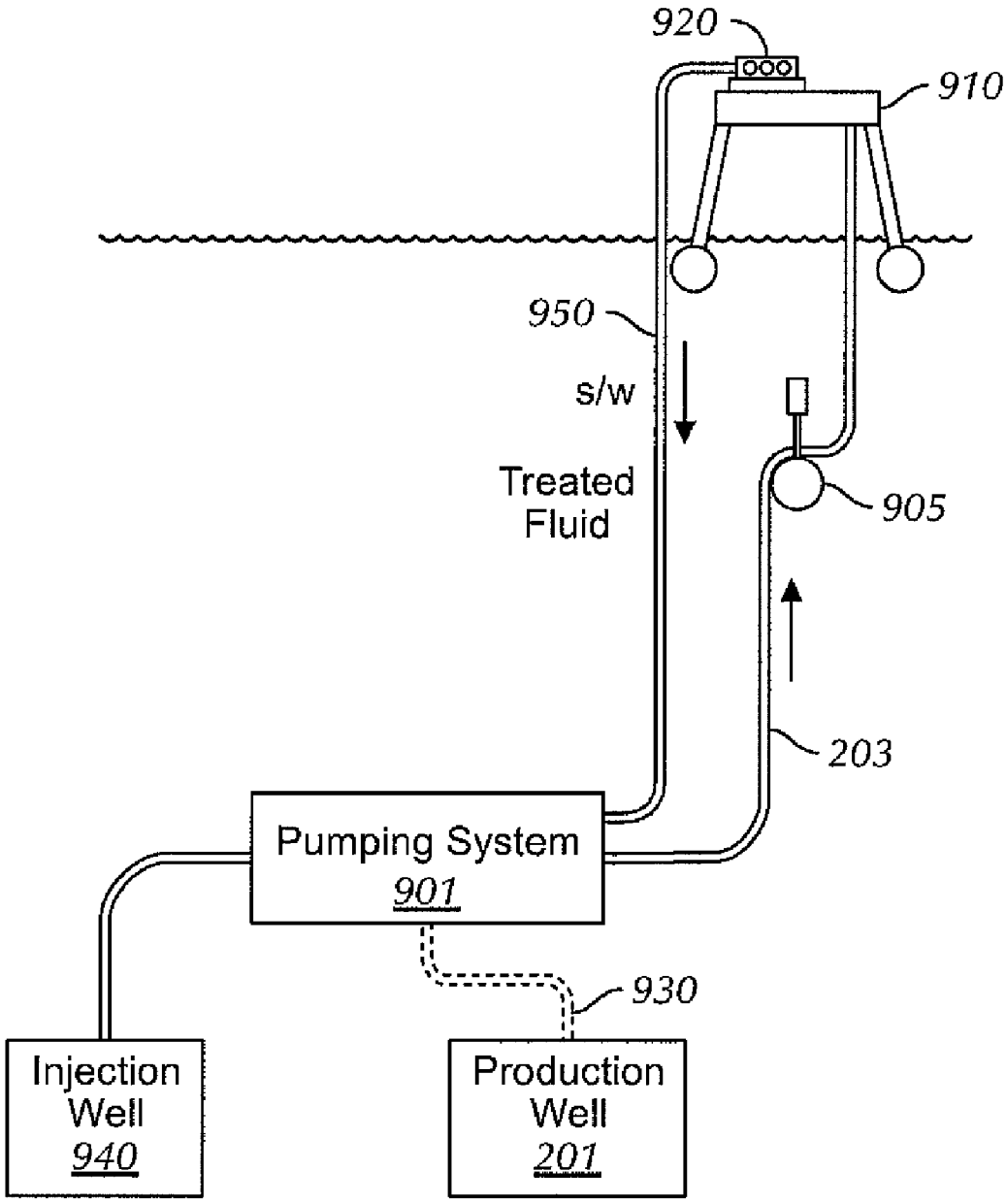
FIG. 8 shows a pumping system using the pressure of an injection well to assist in pumping in accordance with an embodiment of the present invention.

In FIG. 8, a configuration for a pumping system 901 in accordance with an embodiment of the present invention is shown. The pumping system 901 in FIG. 8 may be configured so that well fluid from a production well 201 is assisted while pumping injection fluid into an injection well 940 from an injection fluid apparatus 920 located at the offshore well site 910. As used herein, "injection fluid apparatus" refers to the apparatus or combination of apparatuses that provides injection fluid. In FIG. 8, the pumping system 901 is illustrated as a block and may be any pumping system that is configured such that an external pressure source can assist the actuation of the pumping system, such as embodiments of the invention described above. Injection wells such as 940 are commonly used in the oilfield for disposal of contaminated fluids and for maintaining pressure in a reservoir from which one or more production wells such as 201 are producing.

In a typical injection well offshore for pressurizing the reservoir, saltwater is filtered and treated in an injection fluid apparatus 920 and then pumped into the injection well 940. In the embodiment shown in FIG. 8, the injection fluid is pumped through injection line 950 to pumping system 901 as described above with respect to the pumping element shown in FIG. 2. The injection fluid acts as the working fluid. In the fill stroke, as the injection fluid is pumped into the injection well 940 (instead of being discharged to ambient seawater as in FIG. 2), well fluid is drawn from the production well 201. Then, during the pump stroke, injection fluid is pumped into the pumping system 901 from the injection fluid apparatus, which pumps well fluid through production line 203 to a subsequent location, such as a riser 905.

An advantage of combining injecting fluid into an injection well 940 while drawing well fluid from production well 201 is that a single surface pump can be used to both supply the injection well 940 and actuate the pumping system 901. Further, the relative pressures between the injection well, the production well 201, and the hydrostatic pressure at the depth of the pumping system 901 can be used to reduce the amount of pressure needed from a surface pump to actuate the pumping system 901. Typically, a production well 201 has a lower pressure than an injection well, in particular one that is being used to recharge the same formation as the production well is drawing well fluid from. Depending on the particular injection well 940 and the depth at which the pumping system 901 is located, the pressure of the injection well 940 may be lower than the hydrostatic pressure of the ambient seawater. When the injection well 940 has a lower pressure than the ambient seawater, the pressure required from a surface pump to draw well fluid from the production well 201 during the fill stroke is reduced by about that pressure differential.

In effect, a negative pressure differential between the injection well 940 and the ambient seawater acts as a "free pump" to reduce pressure resistance to the surface pump as it actuates the pumping system 901 to draw well fluid from the production well 201. For example, an injection well 940 typically has a pressure of about 1500 psi to about 1800 psi. Assuming that the injection well 940 has a pressure less than about 1800 psi and that the pumping system 901 is submerged in seawater, a negative pressure differential between the ambient seawater and the injection well 940 would exist when the pumping system 901 is submerged at a depth greater than about 4050 feet. For a pressure less than about 1500 psi, the negative pressure differential would exist when the pumping system 901 is submerged at a depth greater than about 3380 feet. Those having ordinary skill in the art will appreciate that a negative pressure differential is only needed to provide pressure assistance from the injection well 940, and that other advantages may exist when the injection well 940 and the production well 201 are connected to a common pumping system 901 even when the pressure of the injection well 940 is greater than the hydrostatic pressure at the depth at which the pumping system 901 is submerged. Further, although the greatest hydrostatic pressure exists on the sea floor, embodiments of the present invention, including the one shown in FIG. 8, do not require that the pumping system 901 to be on the sea floor or in any other specific location or depth.

As described in connection with some exemplary embodiments above, the invention may advantageously facilitate the pumping of well fluids, and may be used even when the wellhead pressure is below that of ambient hydrostatic pressure. While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A method of manufacturing a pressure driven pumping system, the method comprising:

providing a separating member within a first bore of a housing to separate a process chamber from a working chamber, the separating member being movable within the housing;

providing a rod member in contact with the separating member and to extend into a reduced pressure chamber, the reduced pressure chamber being sealed from the working chamber and configured for sustaining a pressure less than a pressure in the working chamber;

attaching one or more working fluid ports to pass through the housing to the working chamber; and fluidly connecting one or more working fluid valves to the one or more working fluid ports for controlling flow through the one or more working fluid ports, wherein the separating member comprises a first face exposed to a process fluid and a second face exposed to a working fluid, the first face having an effective area greater than an area of the second face, wherein the working chamber is sandwiched between the process chamber and the reduced pressure chamber such that the rod member extends through the entire working chamber, and wherein at least one of the working fluid ports is in fluid communication with a pump for passing working fluid into the working chamber.

2. The method of claim 1, further comprising:

selecting a rod member diameter and a separating member diameter such that a force applied by the working fluid to the separating member exceeds a force applied by a process fluid to the rod member according to a selected range of well fluid pressure and a selected range of seawater depth.

3. The method of claim 2, wherein the separating member is a piston and the piston comprises a first face exposed to the process chamber and a second face exposed to the working chamber, the second face having an effective area equal to between 25% and 75% of an effective area of the first face.

4. The method of claim 1, further comprising:

disposing a rolling diaphragm within the process chamber.

5. The method of claim 1, further comprising:

configuring at least one of the working fluid ports to be in fluid communication with seawater when the housing is submerged in the seawater.

6. The method of claim 1, further comprising:

providing one or more process fluid ports to pass through the housing to the process chamber, wherein at least one of the process fluid ports is adapted for fluid communication with a subsea wellhead.

7. The method of claim 6, wherein at least one of the process fluid ports is adapted for fluid communication with a production line.

8. The method of claim 1, further comprising:

fluidly connecting a flow control device to the working chamber for controlling flow of working fluid out of the working chamber.

9. The method of claim 1, further comprising:

attaching a diaphragm to the housing for preventing migration of fluid from the process chamber to the working chamber.

10. A method for manufacturing a pumping system to be connected to a subsea well for extracting a well fluid from the well, the method comprising:

providing in a housing a process chamber, a working chamber and a reduced pressure chamber in this order;

placing a separating member within a first bore of the housing to separate the process chamber from the working chamber, the separating member being movable within the housing;

attaching a rod member to the separating member and extending it through the working chamber into the reduced pressure chamber, the reduced pressure chamber being sealed from the working chamber and configured to sustain a pressure less than a pressure in the working chamber;

connecting a first port of the process chamber to the well and a second port configured to be connected to a pipe that takes the well fluid to a surface of sea;

connecting a first port of the working chamber to ambient seawater and a second port configured to be connected to an external pump;

providing the pressure reduced chamber with a single port; and selecting a ratio of an area of a face of the separating member to an area of a face of the rod member such that a pressure of the well fluid, when smaller than a pressure of the ambient seawater, pushes out the seawater from the working chamber and the well fluid into the process chamber.

11. A method for manufacturing a pressure driven pumping system, the method comprising:

providing a separating member within a first bore of a housing to separate a process chamber from a working chamber, the separating member movable within the housing;

attaching a rod member to the separating member and extending into a reduced pressure chamber, the reduced pressure chamber being sealed from the working chamber and configured for sustaining a pressure less than a pressure in the working chamber; and providing one or more process fluid ports to pass through the housing to the process chamber, wherein at least one of the process fluid ports is adapted for fluid communication with a subsea wellhead, wherein the separating member comprises a first face exposed to a process fluid and a second face exposed to a working fluid, the first face having an effective area greater than an area of the second face, and wherein the working chamber is sandwiched between the process chamber and the reduced pressure chamber such that the rod member extends through the entire working chamber.

12. The method of claim 11, further comprising:

providing the separating member in sealing engagement with the first bore of the housing.

13. The method of claim 12, wherein the separating member is a piston and the piston comprises a first face exposed to the process chamber and a second face exposed to the working chamber, the second face having an effective area equal to between 25% and 75% of an effective area of the first face.

14. The method of claim 11, further comprising:

providing one or more working fluid ports to pass through the housing to the working chamber;

providing one or more working fluid valves for controlling flow through the one or more working fluid ports; and wherein at least one of the working fluid ports is in fluid communication with a pump for passing working fluid into the working chamber.

15. The method of claim 14, further comprising:

fluidly connecting at least one of the working fluid ports with seawater when the housing is submerged in the seawater.

16. The method of claim 11, further comprising:

fluidly connecting at least one of the process fluid ports with a production line.

17. The method of claim 11, further comprising:

fluidly connecting a flow control device with the working chamber for controlling flow of working fluid out of the working chamber.

18. The method of claim 11, further comprising:

providing a diaphragm within the housing for preventing migration of fluid from the process chamber to the working chamber.

19. The method of claim 18, wherein the diaphragm comprises a rolling diaphragm disposed within the process chamber.

20. A method for manufacturing a pressure driven pumping system, the method comprising:

providing a separating member within a first bore of a housing to separate a process chamber from a working chamber, the separating member movable within the housing;

attaching a rod member to the separating member and extending it into a reduced pressure chamber, the reduced pressure chamber being sealed from the working chamber and configured for sustaining a pressure less than a pressure in the working chamber; and providing a diaphragm within the housing for preventing migration of fluid from the process chamber to the working chamber, wherein the separating member comprises a first face exposed to a process fluid and a second face exposed to a working fluid, the first face having an effective area greater than an area of the second face, and wherein the working chamber is sandwiched between the process chamber and the reduced pressure chamber such that the rod member extends through the entire working chamber.

* * * * *